United States Patent [19]

Phelps

[11] Patent Number: 4,495,886

[45] Date of Patent: Jan. 29, 1985

[54] PRECISION ROLL COATER

[75] Inventor: Richard W. Phelps, Fulton, N.Y.

[73] Assignee: The Black Clawson Company, Middletown, Ohio

[21] Appl. No.: 536,021

[22] Filed: Sep. 26, 1983

[51] Int. Cl.[3] ..... B05C 1/08

[52] U.S. Cl. ..... 118/249; 118/262

[58] Field of Search ..... 118/249, 262

[56] References Cited

U.S. PATENT DOCUMENTS

| | | | |
|---|---|---|---|
| 2,236,239 | 3/1941 | Lipton | 118/262 X |
| 2,681,636 | 6/1954 | Fridolph | 118/262 X |
| 3,605,687 | 9/1971 | Russell | 118/262 |
| 4,029,833 | 6/1977 | Kosta | 118/262 X |

*Primary Examiner*—John P. McIntosh

*Attorney, Agent, or Firm*—Biebel, French & Nauman

[57] ABSTRACT

A roll-type coater for applying a coating material to a web of paper includes an actuator mechanism for accurately controlling the movement and position of a metering roll with respect to a coating transfer roll, to prevent shock loading of the transfer roll upon closing movement of the metering roll, and to provide for rapid opening of the metering roll when necessary. The mechanism includes a bellcrank and link connected to move the metering roll along guideways, in which the linkage approaches, but does not exceed, an overcenter position just before the metering roll comes into contact with one or more micrometer blocks which space it accurately from the coating roll. A movable stop is provided which engages the bellcrank just prior to closing of the rolls, to absorb the impact and prevent the same from being transferred to the adjacent rolls and retracts, permitting final rotation of the bellcrank and the associated movement of the metering roll into its final metering position, with the loads all stacked in one direction. The movable stop may be operated against the bellcrank to open up the nip between the rolls, when necessary.

8 Claims, 2 Drawing Figures

PRECISION ROLL COATER

BACKGROUND OF THE INVENTION

This invention relates to roll coaters and more particularly to a roll coater in which the positioning of the metering roll may be controlled with high precision.

The invention relates generally to the type of coater as shown in the patent of Fridolph, U.S. Pat. No. 2,681,636 of June 22, 1954, in which a metering roll is movable on guideways into and out of engagement with a coating transfer roll which, in turn, applies a metered quantity of coating to a web of paper threaded between the coating transfer roll and a backing roll. Cylinder motors have been used in roll coaters to provide for rapid movement of the rolls and to bias the metering roll against adjustable stops spacing it from the transfer roll, all as shown in Fridolph above.

It is particularly desirable to be able to move the metering roll a substantial distance out of contact with the coating transfer roll from a closely controlled metering position to a retracted position, for safety's sake, and for cleaning of the machine. It is of prime importance in precision coaters to provide an arrangement for returning the metering roll to its predetermined relationship with the coating transfer roll.

For example, metering rolls and the supporting bearing assemblies, can be made with a total indicated runout of near zero. Using such precision roll coating equipment, the gap between that roll and the coating transfer roll can be as small as 0.000750" (750 micro-inches), and the tolerance required of the metered coating film on the web may be in the order of plus or minus 5% thickness or 0.000075" (75 micro-inches). Thus, a mechanism which has the capability of operating at such close tolerances, must be one in which the same can be established and reestablished from time to time after the rolls have been moved to a retracted position. Any substantial shock loading created when the metering roll bearing housings contact the spacer blocks in the guideways separating these bearing housings from those of the coating transfer roll, can result in disorientation of the rolls and the supporting structure to a degree geater than the plus or minus 5% thickness tolerance in the 75 micro-inch range. There is accordingly a need for an actuating mechanism which may be operated for quickly opening the metering roll from the transfer roll, moving the metering roll to a substantial retracted position, to provide for a 4" gap or the like, and for returning the same to a precisely controlled coating position without undue shock, so as to maintain a predetermined optimum coating condition.

Further, depending on the coating material being metered, the speed of operation, and the width of the coater, there are instances when the metering force actually causes the metering roll to deflect by an amount greater than the coating thickness. In such cases, a cross-axis control or crown must be put on the metering roll to compensate for such deflection. However, in conventional coater apparatus, the closing movement is not controlled in such a manner as to allow a metering force to be built up or generated as the metering roll approaches its metering position, and thus problems with the crown actually contacting the transfer roll surface have occurred. For this additional reason there exists a requirement for providing greater control in the closing movement of the metering roll with respect to the transfer roll.

SUMMARY OF THE INVENTION

The invention accordingly is directed to a precision roll type coater in which a coating roll applies a metered quantity of coating to a web which is supported on a backing or backup roll, in which the metering roll is mounted for transverse movement on guideways, and in which the movement is controlled by a pivotal crank-type mechanism, such as a bellcrank, and operated by a suitable cylinder motor or the like, and in which the pivot connection between a link connecting the metering roll to the bellcrank is such that an imaginary line through the link pivots approaches a parallel relationship with a line drawn from the rotational axis of the bellcrank to the pivot link, as the metering roll approaches a point of contact with the coating transfer roll. The same imaginary line approaches a generally right-angle relationship when the crank is rotated to push the metering roll away from the transfer roll. As a result, when a retracting force is applied to the bellcrank assembly, on each side of the coater, the metering roll will move at an accelerating rate from its metering position to its fully retracted position and conversely, when a closing force is applied, the metering roll moves at a decelerating rate as it approaches the predetermined metering position, assuming a uniform rate of rotation of the bellcrank. When the metering roll finally comes into a predetermined metering position, the bearing block, which is mounted for sliding movement on the guideways, comes into contact with one or more precision micrometer spacing blocks.

A movable stop is provided and is positioned to come into contact with a portion of the bellcrank assembly near the closed or coating position. This stop may also be considered as an adjustable stop which engages the bellcrank linkage as it approaches its coating position, but prior to the connecting link bringing the metering roll into stacked-up engagement with the micrometer spacing blocks. This adjustable or moving stop acts on the bellcrank to absorb the closing impact or force, before the metering roll actually reaches its metering position and before the micrometer blocks are contacted. Thereafter, the movable or adjustbale stop is retracted at a controlled rate, while the air continues to be applied to the piston motor, allowing the metering roll now to move easily into its metering position. The adjustable stop over travels or backs away after the metering roll has been positioned for metering, and thus transfers the closing force back to the bellcrank and linkage assembly, holding the metering roll firmly in metering position against the micrometer blocks.

The arrangement as described above has the advantages of gently bringing the metering roll into its precise metering position maintaining the closing force on the linkage and on the bearing blocks in the same direction, and providing rapid opening movement in the event it becomes necessary to move the metering roll away from the transfer roll.

However, in normal operation, when there is no requirement to move the metering roll to the full retracted or 4" gap position, the motorized stops on either side of the coater acting on the bellcrank assembly, may be used to open the metering nip by a small amount without reversing the closing force on the bellcrank. When these adjustable stops are retracted, the metering roll moves back under the influence of the air motor and bellcrank linkage to its metering position without load reversals.

It is accordingly an important object of the this invention to provide a roll-type coater in which the position of the metering roll with respect to the coating transfer roll may be controlled with a high degree of accuracy.

Another object of the invention is to provide a roll-type coater, as outlined above, in which the metering roll may be moved quickly away from its running position with respect to a coating transfer roll, and returned to an accurately defined position and moved gently into place without undue impact against the bearing block for the coating transfer roll.

A still further object of the invention is to provide a micrometer adjustment arrangement by which small changes in the position of a metering roll may be easily effected, while maintaining the closing forces tending to bring the metering roll into closing relation with the coating transfer roll.

A still further object of the invention is to provide a cam linkage arrangement in which the geometry of the pivot point on a connecting link comes nearly in line with a radius through the pivot point, just at closing, so that the movement of the metering roll is substantially decelerated, and impact forces are maintained at a minimum.

A still further object is the provision of a roll-type coater, as outlined above, including a motorized or movable stop which is positioned to engage a crank or cam portion on a crank just prior to closing the gap between a metering roll and a coating transfer roll, which stop may then be backed away slowly so as to close completely the gap between such rolls, as determined by one or more intervening micrometer blocks, with a minimum of impact force which would otherwise tend to create misadjustment or misalignment in a high precision roll coater.

These and other objects and advantages of the invention will be apparent from the following description, the accompanying drawings, and the appended claims.

DESCRIPTION OF PREFERRED EMBODIMENT

Figure 1:
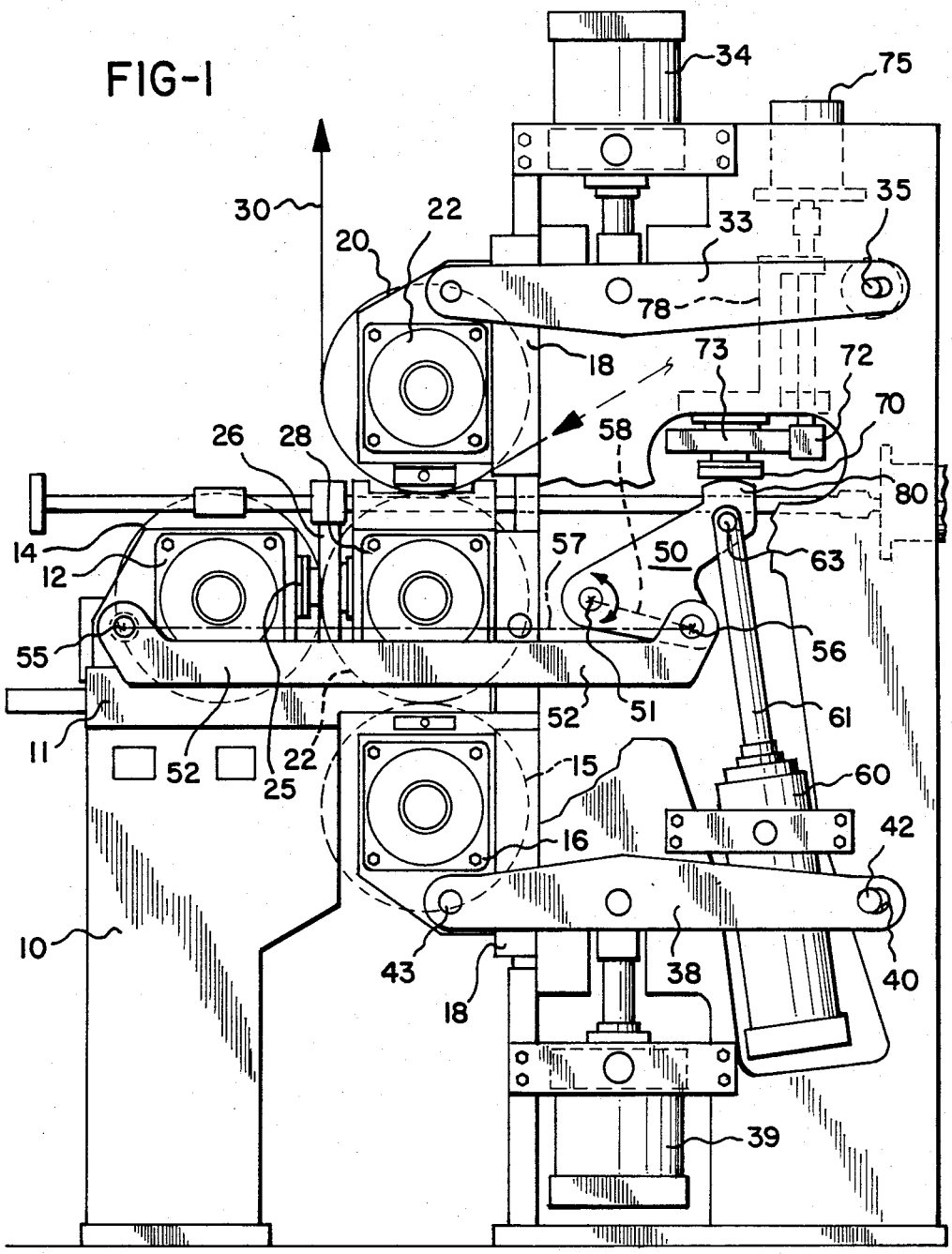
FIG. 1 is a side view, with portions broken away, of a roll-type coater in accordance with this invention, showing metering roll in its operative or coating position.

Referring to the drawings which illustrate a preferred embodiment of the invention, the roll-type coater of this invention is shown from one side frame of the machine only, it being understood that the operative mechanisms are essentially duplicated at the opposite side frame of the machine. Further, while the invention illustrated is in terms of a pick-up roller which would normally receive coating material from a pan (not shown), it may be understood that the coating may be applied to the coating transfer roll in any conventional manner including a fountain applicator, or the like. Additionally, the manner in which the bearing housings or bearing blocks which support the respective rolls are movable in bearing block guideways, as used in the present invention, is known in the art, as shown for example in the previously mentioned patent of Fridolph, U.S. Pat. No. 2,681,636. Also, since that patent shows a coating pan and its relation to the pick-up roll, in the interest of clarity, the pan has been omitted from the present drawings.

An end frame stand 10 is provided with a horizontal guideway 11 which slidably supports the bearing block 12 at one end of a metering roll 14. Of course, a corresponding frame, bearing block and guideway is provided at the opposite frame. A pick-up roll 15 is also mounted on a bearing block 16 which is movable along a vertical guideway 18. A backing roll 20 is also provided with a bearing block 21 which is movable along the vertical guideway 18. The pick-up roll 15 and backing roll 20 are positioned at opposite vertical sides of a coating transfer roll 22. For the purpose of illustrating and describing the present invention, it may be assumed that the coating transfer roll 22 is mounted generally at the intersection of the horizontal and vertical guideways 11 and 18 and is rigidly supported on the frame 10.

One or more micrometer blocks 25 may be positioned between the bearing housing 12 of the metering roll and an adjustable stop 26 adjacent the bearing block 28 of the coating transfer roll 22. A web 30 of paper or the like to be coated is shown as being partially wrapped about the backing roll 20, passing a nip between the coating transfer roll 22 and the backing roll 20.

Figure 2:
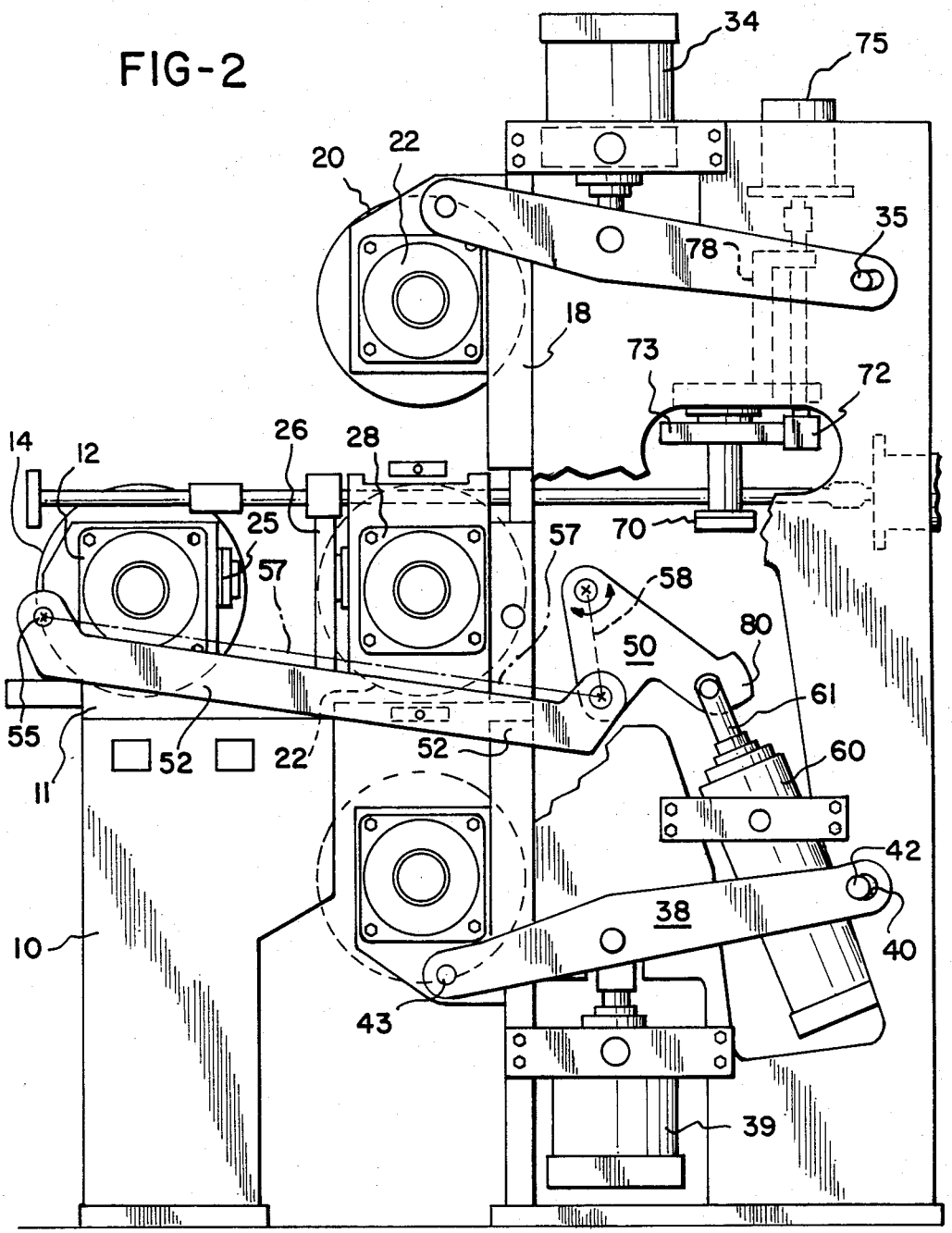
FIG. 2 is a view similar to FIG. 1 showing the metering roll retracted and showing the pick-up roll and back-up roll also in a retracted position.

The backing roll 20 is movable along the vertical guideway 18 by a pivot lever 33 controlled by an air cylinder 34. The lever 33 is pivoted to the frame 10 by a slotted pivot arrangement at 35 on one end, and is pivoted to the bearing housing 21 of the roll 20 on the other end, for movement by the cylinder 34 between a running position shown in FIG. 1 and a retracted or threading position as shown in FIG. 2. Similarly, the pick-up roll 15, is movable along the vertical guideways 18 by another lever 38, controlled by an air cylinder 39. The lever is slotted at 40 for movement about a fixed pin 42 on the frame 10, and is pivoted at 43 to the block 16, and operates to move the pick-up roll between an operative position as shown in FIG. 1 and a retracted position as shown in FIG. 2. It is understood that corresponding roll moving structure is mounted on an opposite end frame, and the mounting of and movement of the rolls 15 and 20 with respect to the transfer roll 22 is conventional and well known in the art.

In the type of coater shown, the weight of coating may be accurately controlled by positioning the metering roll 14 in closely controlled relation to the transfer roll 22. This accurate space is determined by the positioning of one or more of the micrometer blocks 25 between the stop 26 and the bearing housing 12 for the roll 14. When precision bearings are used, there can be a minimum of total indicated run out, which may approach zero, thus permitting the control of a gap as small as 750 microinches with a tolerance of plus or minus 5%, as noted above. However, this precisely controlled metering gap cannot be maintained where the closing movement of the metering roll 14 on the guideways 11 results in a shock load or impact since such a shock load can cause disorientation of the rolls and supporting structure to a degree greater than a 75 microinch tolerance.

Accordingly, the invention provides an arrangement by which the metering roll may be moved from its fully retracted position as shown in FIG. 2 to its operating position as shown in FIG. 1, minimizing or eliminating altogether the shock or impact loading when closing from the open to the closed position. For this purpose, on each side of the coater, there is provided a bellcrank 50 mounted on the frame for pivotal movement about a center or axis 51, which center or axis preferably includes a torque rod connection across the machine to a corresponding bellcrank on the opposite side of the frame. The bellcrank 50 is, in turn, connected to the bearing block 12 by means of a rigid connecting link 52. It will be understood that each side of the machine will have a connecting link as shown in FIGS. 1 and 2 connected to a corresponding bellcrank. The forward end of the connecting link 52 is joined to the bearing block 12 at a pivot pin 55 whereas the rear or inner end of the link 52 is connected to the bellcrank 50 at a pivot 56. It will be seen that an imaginary line 57 extending between the pivots 55 and 56 of the link 52 approaches a condition of parallelism with a radius 58 from the pivot axis 51 of the bellcrank 50 to the pivot 56, in the closed position of the metering roll as shown in FIG. 1. Such line 57 approaches a 90° to radius 58 relationship in the fully retracted position, as shown in FIG. 2.

Movement of the bellcrank 50 may be effected by a pivotally mounted cylinder motor 60 having its cylinder rod 61 connected to the bellcrank 50 at a pivot connection 63. Normally a cylinder motor 60 would be provided at each side of the frame. The arrangement therefore, is such that during closing, the initial rate of closing movement is greatest, and as the centerline 57 between the pivot points 55 and 56 approaches a condition of parallelism with a radius 58, the rate becomes progressively slower.

In order fully to prevent shock loading, the mechanism further includes an adjustable stop means cooperating with the bellcranks 50. The adjustable stop means includes a motorized stop 70 which is movable vertically by a spur drive gear 72 engaging a drive wheel 73 in threaded relation to the stop 70, and movable by an adjusting motor 75 on a common subframe 78. The motor 75 may be a stepping motor, for example. The bellcrank 50 is provided with a nose or cam portion 80 which, just prior to closing of the metering roll 14, comes into engagement with the adjustable stop 70. The stops 70 on either side of the coater, operating on the bellcrank, thus fully absorb the input force before the metering roll 14 reaches its metering position, and before the micrometer blocks 25 are contacted. Thereafter, the motor 75 is operated to retract the stops 70 at a controlled rate, thus allowing the metering roll to move into a metering position against the micrometer blocks 25. Thereafter the stops 70 overtravel after the roll has been positioned for metering, thus transferring the closing force as applied by the cylinder 60 back to the bellcrank and linkage mechanism, holding the metering roll firmly in metering position during operation.

During normal operation, when there is no requirement to move the metering roll 14 to its full retracted position, as shown in FIG. 2, the motorized stops 70 may be operated to act upon the cam portion 80 of the bellcrank, for the purpose of opening the metering nip a small amount between the rolls 14 and 22. Thus, the stops 70, as positioned by the motor 75, allow the metering roll to be moved by a small amount during machine stops and setups. When the stops are retracted, the roll will move back to its metering position, without load reversal. Accordingly, any slack between any of the various pivoted connections is fully taken up in the same direction, further enhancing the ability to provide for accurate metering control.

Depending on the coating being metered, the speed of operation, or the width of the machine, there are times when the metering force applied to the metering roll causes the same to be deflected by an amount which approaches or may be greater than the coating thickness. In such cases, a cross axis control or a crown must be applied to the metering roll to maintain a constant gap across the roll at the nip between the rolls 14 and 22. The controlled rate of closure provided by the motorized stops 70 on the cam portion 80 of the bellcrank 50 allows the metering force to be generated as the roll 14 approaches its metering position, thus deflecting the roll and preventing the crown from coming into contact with the transfer roll surface. While this disclosure is based on the use of a bellcrank, it should be noted that the same result could be obtained by the use of a second set of wedge blocks, cams, etc., so motorized as to give essentially the same result.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a precision roll type coater in which a coating transfer roll applies a metered quantity of coating material to a moving web of paper or the like supported on a back-up roll, which quantity of coating material is controlled by a metering roll running in close relation to a coating transfer roll, the improvement comprising:

a frame, bearing block means mounting said coating transfer roll on said frame, means for applying an excess of coating material to the coating transfer roll for metering by said metering roll, guideways on said frame for mounting said metering roll providing for translatory movement of said metering roll toward and away from said coating transfer roll, bearing blocks mounting said metering roll in said guideways for such translatory movement, links having one end pivotally connected to said metering roll bearing blocks, a bellcrank for each of said links, each said bellcrank having a pivotal connection to said frame and further having a pivotal connection to one of said links so that rotational movement of said bellcranks is accompanied by translatory movement of said metering roll along the path of said guideways, the pivotal connection of each of said links on the respective said bellcranks being positioned such that an imaginary line through the pivotal connections of said links with said blocks and said bellcranks approaches parallelism with a radius from the bellcrank pivot axis to the link pivot connection, as said metering roll approaches said coating transfer roll, and said imaginary line approaches a generally right-angle relationship to said radius when said bellcranks are rotated to move said metering roll away from said transfer roll, so that rotation of said bellcranks from a first open position to a second operable position results in an initially rapid movement of said metering roll toward said coating transfer roll followed by a slowing down of the rate of movement of said metering roll as said metering roll approaches said coating transfer roll, movable stop means positioned to engage said bellcranks as said link approaches its second said position, fixed stop means between the bearing block means of said coating transfer roll and said metering roll bearing block defining the metering position of said metering roll with respect to said transfer roll, said movable stop means being operable to retreat from engagement with said bellcranks following contact of said bearing blocks with said fixed stop means, to provide for the biasing of said bearing blocks against said fixed stop means by said bell crank, and actuator means connected to rotate said bellcranks.

2. A precision roll-type coater in which a coating transfer roll applies a metered quantity of coating material to a web of paper or the like supported on a back-up roll, and in which the thickness of the coating is controlled by a metering roll running in close relation to the coating transfer roll, comprising:

a frame, bearing block means mounting said coating transfer roll for rotation on said frame, means applying coating material to said transfer roll, guideways on said frame, bearing blocks on said metering roll receivable in said guideways, said metering roll movable on said guideways between a first position in which said metering roll is spaced substantially from said transfer roll, and a second position in which said metering roll is in close metering relationship with said transfer roll, micrometer block means positioned between said metering roll bearing blocks and the bearing block means supporting said transfer roll to define the said second position of said metering roll, means for moving said metering roll between said first and second positions without imposing a shock loading on said transfer roll and for maintaining said second position, including rotatable bellcranks on said frame, one at each end of said metering roll, means mounting said bellcranks on said frame for rotation about an axis of rotation, connecting links, one for each of said bellcranks, said connecting links having one end pivotally connected to one of said bearing blocks and having the other end thereof pivotally connected to one of said bellcranks, said pivotal connection of said bellcranks and said links moving toward, but not past, an over-center position with respect to said axis of rotation in said second position so that the rate of movement of said metering roll and said guideways decreases as it approaches said second position, actuator means for rotating said bellcranks to cause said metering roll to move between its said first and second positions, a cam portion on said bellcranks, movable stop means on said frame engageable with said bellcrank cam portion as said bellcranks approach an over-center position, to receive impact thereon prior to engagement of said metering roll bearing blocks with said micrometer block means, said movable stop means being retractable to permit completed rotation of said crank means by said actuator means toward said over-center position bringing said metering roll into its said second position against said mircrometer block means without impact loading.

3. The coater of claim 2 in which said movable stop means are motor controlled and are engageable with said bellcranks at said cam portions for opening the gap between said metering roll and said coating transfer roll against the bias of said actuator means.

4. The coater of claim 2 in which a line between the pivotal connections of said links with said bearing blocks and said bellcranks approaches parallelism with a radius from the axis of rotation of said bellcranks to said link pivotal connection in said second position, and approaches a right angle thereto in said first position.

5. In a precision coater including a coating transfer roll, a backing roll, and means applying a surplus of coating to said transfer roll, the improvement comprising:

a metering roll, means mounting said metering roll for movement between a first position spaced substantially from said transfer roll to a metering position in close relation with transfer roll, positioning means for establishing a fixed metering relationship between the surfaces of the metering and transfer rolls at said metering position, motive means connected to said metering roll for moving said metering roll between its said positions, and movable stop means positioned to intercept the moving metering roll prior to the position established by said positioning means providing a controlled rate of closure of the metering roll to its said metering position by said motive means, said movable stop means becoming disengaged from said metering roll when said positioning means establishes said metering relationship between the surfaces of said metering and transfer rolls.

6. The coater of claim 5 in which said movable stop means is operable to reengage said metering roll for separating said metering and transfer rolls apart by a small distance.

7. In a precision roll type coater in which a coating transfer roll applies a metered quantity of coating material to a moving web of paper or the like supported on a back-up roll, which quantity of coating material is controlled by a metering roll running in close relation to a coating transfer roll, the improvement comprising:

a frame, bearing block means mounting said coating transfer roll on said frame, means for applying an excess of coating material to the coating transfer roll for metering by said metering roll, guideways on said frame for mounting said metering roll providing for translatory movement of said metering roll toward and away from said coating transfer roll, bearing blocks mounting said metering roll in said guideways for such translatory movement, at least one link having one end pivotally connected to said metering roll at a bearing block, a bellcrank having a pivotal connection to said frame and further having a pivotal connection to said link so that rotational movement of said bellcrank is accompanied by translatory movement of said metering roll along the path of said guideways, the pivotal connection of said link on said bellcrank being positioned such that an imaginary line through the pivotal connection of said link with said metering roll and said bellcrank approaches parellelism with a radius from the bellcrank pivot axis to the link pivot connection, as said metering roll approaches said coating transfer roll, and said imaginary line approaches a generally right-angle relationship to said radius when said bellcrank is rotated to move said metering roll away from said transfer roll, so that rotation of said bellcrank from a first open position to a second operable position results in an initially rapid movement of said metering roll toward said coating transfer roll followed by a slowing down of the rate of movement of said metering roll as said metering roll approaches said coating transfer roll, stop means between the bearing block means of said coating transfer roll and said metering roll bearing block engaging the respective said bearing block prior to said imaginary line obtaining a condition of parallelism with said radius and defining the metering position of said metering roll with respect to said transfer roll, and actuator means connected to rotate said bellcrank.

8. The coater of claim 7 in which said bellcrank pivotal connection is on said frame at a side of said coating transfer roll remote from said metering roll and in which said imaginary line in said second position is substantially parallel to a line between the centers of rotation of said metering roll and said transfer roll so that the compressive forces applied by said metering roll to said stop means in said second position is opposed by the tension applied to said link by said bellcrank in said second position.

* * * * *